US006903311B2

(12) United States Patent
Tembe

(10) Patent No.: US 6,903,311 B2
(45) Date of Patent: Jun. 7, 2005

(54) METHOD AND APPARATUS FOR CONTROLLING AN ELECTRIC COOKING APPLIANCE

(75) Inventor: Nicholas George Tembe, Worcester (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 10/477,033

(22) PCT Filed: May 15, 2002

(86) PCT No.: PCT/GB02/02313

§ 371 (c)(1),
(2), (4) Date: Mar. 31, 2004

(87) PCT Pub. No.: WO02/096157

PCT Pub. Date: Nov. 28, 2002

(65) Prior Publication Data

US 2004/0149727 A1 Aug. 5, 2004

(30) Foreign Application Priority Data

May 18, 2001 (GB) ..... 0112120

(51) Int. Cl.[7] ..... H05B 1/02

(52) U.S. Cl. ..... 219/492; 219/497; 219/483; 219/448.12; 219/412; 307/38

(58) Field of Search ..... 219/412–414, 219/448.12, 483–486, 492, 448.14, 497, 626, 501, 506, 508; 307/38–40, 117

(56) References Cited

U.S. PATENT DOCUMENTS 4,634,843 A * 1/1987 Payne ..... 219/486
4,772,779 A 9/1988 Scheidler et al.
5,250,775 A * 10/1993 Maehara et al. ..... 219/771
6,218,646 B1 4/2001 Nass et al.
2002/0117497 A1 * 8/2002 Bassill et al. ..... 219/626

FOREIGN PATENT DOCUMENTS

| | | |
|---|---|---|
| DE | 4104677 | 8/1992 |
| EP | 0886459 | 12/1998 |
| EP | 0999726 | 5/2000 |

OTHER PUBLICATIONS

International Search Report Sep. 3, 2003.

United Kingdom Search Report Jan. 22, 2002.

* cited by examiner

*Primary Examiner*—Mark Paschall
(74) *Attorney, Agent, or Firm*—Ira S. Dorman

(57) ABSTRACT

In a method and apparatus for controlling an electric cooking appliance, a boost condition is initiated by increasing the power level of one or more electric heating means (2) to a maximum power level from a previous lower power level. Elapsed time (38) during cooling of the appliance since an end of an immediately previous period at the maximum power level is monitored, as is difference in power levels between the maximum power level and the previous lower power level. Duration (34) of the boost condition is set according to one of the elapsed time (38) and the difference in power levels and a level (36) of temperature boost in the boost condition is correspondingly set according to one of the difference in power levels and the elapsed time respectively.

46 Claims, 2 Drawing Sheets

METHOD AND APPARATUS FOR CONTROLLING AN ELECTRIC COOKING APPLIANCE

This invention concerns a method and apparatus for controlling an electric cooking appliance, such as an electric oven and/or an electric hob, which hob may be provided with a glass-ceramic cooking surface.

It is well known to provide electric cooking appliances, such as ovens and/or hobs, having one or more electric heaters which is or are controlled to provide a desired operating temperature and/or rate of heating of the appliance. An energy regulating means is provided for controlling the heater or heaters and one or more temperature sensing means is or are provided to monitor the temperature of the appliance and provide control signals which enable energising of the one or more heaters to be regulated.

It is known to provide electronic control arrangements in which the temperature sensing means comprises one or more electrical resistance temperature detectors, such as platinum resistance temperature detectors.

Cooking appliances, such as ovens and/or hobs, are generally controlled such that they have a predetermined safe long term maximum operating temperature, which can be used continuously without damage to the appliance. However, it has been established in EP-A-0 886 459 that improved performance of the appliance can be obtained if, at the commencement of a cooking cycle, a boost condition is provided whereby the operating temperature of the appliance is boosted above the safe long term maximum operating temperature to a boost temperature which is a predetermined safe short term operating temperature.

A problem exists in that the duration of the boost condition and the level of temperature boost in the boost condition require careful control in recurrent cooking cycles in order to prevent damage to the cooking appliance. This is particularly important in cooking hobs with glass-ceramic cooking surfaces, where overheating of the material of the cooking surface can shorten the life of the surface.

It is an object of the present invention to overcome or minimise this problem.

According to one aspect of the present invention there is provided a method of controlling an electric cooking appliance whereby at commencement of a recurrent cooking cycle a boost condition is selected such that an operating temperature of the appliance is boosted above a predetermined safe long term maximum operating temperature to a boost temperature which is a predetermined safe short term maximum operating temperature, the appliance including energy regulating means for controlling power level of one or more electric heating means in the appliance, and temperature sensing means for monitoring the operating temperature of the appliance, the method comprising: initiating the boost condition by increasing the power level of the one or more electric heating means to a maximum power level from a previous lower power level; monitoring elapsed time since an end of an immediately previous period at the maximum power level and during which cooling of the appliance occurs; monitoring difference in power levels between the maximum power level and the previous lower power level; and setting duration of the boost condition according to one of the elapsed time and the difference in power levels and correspondingly setting a level of temperature boost in the boost condition according to one of the difference in power levels and the elapsed time, respectively.

According to a further aspect of the present invention there is provided apparatus for controlling an electric cooking appliance whereby at commencement of a recurrent cooking cycle a boost condition is selectable such that an operating temperature of the appliance is able to be boosted above a predetermined safe long term maximum operating temperature to a boost temperature which is a predetermined safe short term maximum operating temperature, the apparatus including energy regulating means for controlling power level of one or more electric heating means in the appliance and temperature sensing means for monitoring the operating temperature of the appliance, the apparatus comprising: means to initiate the boost condition whereby the power level of the one or more electric heating means is increased to a maximum power level from a previous lower power level; means to monitor elapsed time since an end of an immediately previous period at the maximum power level and during which cooling of the appliance occurs; means to monitor difference in power levels between the maximum power level and the previous lower power level; and means to set duration of the boost condition according to one of the elapsed time and the difference in power levels and to correspondingly set a level of temperature boost in the boost condition according to one of the difference in power levels and the elapsed time, respectively.

The boost condition may be initiated by increasing a setting of the energy regulating means to a maximum setting from a lower level setting. Such lower level setting may be in a range from a minimum setting, in which the one or more electric heating means is or are not energised, up to about 70 percent of the maximum setting, the one or more electric heating means being energised at the maximum power level in the maximum setting.

In one embodiment of the present invention, a predetermined maximum reference period and a predetermined minimum reference period may be provided, to which the monitored elapsed time is referred.

If the monitored elapsed time is greater than the predetermined maximum reference period, the duration of the boost condition may be set to a maximum value referred thereto. Such predetermined maximum reference period may be about 22–30 minutes and the set maximum value of the duration of the boost condition may be about 7–8 minutes.

If the monitored elapsed time is less than the predetermined minimum reference period, the duration of the boost condition may be set to a minimum value referred thereto. Such predetermined minimum reference period may be about 1 minute and the set minimum value of the duration of the boost condition may be about 0 minutes.

If the monitored elapsed time is between the predetermined maximum reference period and the predetermined minimum reference period, the duration of the boost condition may be set to a value in proportion to the elapsed time, such as about one third of the elapsed time.

If the difference in power levels between the maximum power level and the previous lower power level is relatively small, a correspondingly relatively small change in temperature up to the level of the boost temperature may be effected. The previous lower power level may be about 50 percent of the maximum power level and the change in temperature up to the level of the boost temperature may be about 5 degrees Celsius.

If the difference in power levels between the maximum power level and the previous lower power level is relatively large, a correspondingly relatively large change in temperature up to the level of the boost temperature may be effected. The previous lower power level may be about 10 percent of the maximum power level and the change in temperature up to the level of the boost temperature may be about 20 degrees Celsius.

In a further embodiment of the present invention, the duration of the boost condition is set in proportion to the magnitude of the difference in power levels between the maximum power level and the previous lower power level. In such further embodiment the level of the temperature boost in the boost condition is set in proportion to the monitored elapsed time. Predetermined maximum and minimum reference periods may be provided, to which the monitored elapsed time is referred.

If the monitored elapsed time is greater than the predetermined maximum reference period, the level of the temperature boost is set to a maximum referred thereto.

If the monitored elapsed time is less than the predetermined minimum reference period, the level of the temperature boost is set to a minimum referred thereto.

If the monitored elapsed time is between the predetermined maximum reference period and the predetermined minimum reference period, the level of the temperature boost is set to a value in proportion to the elapsed time.

The temperature sensing means may comprise an electrical resistance temperature detector (RTD), such as comprising a platinum resistance sensing element.

The electric cooking appliance may comprise an electric oven and/or an electric hob.

For a better understanding of the invention and to show more clearly how it may be carried into effect, reference will now be made, by way of example, to the accompanying drawings in which.

Figure 1:
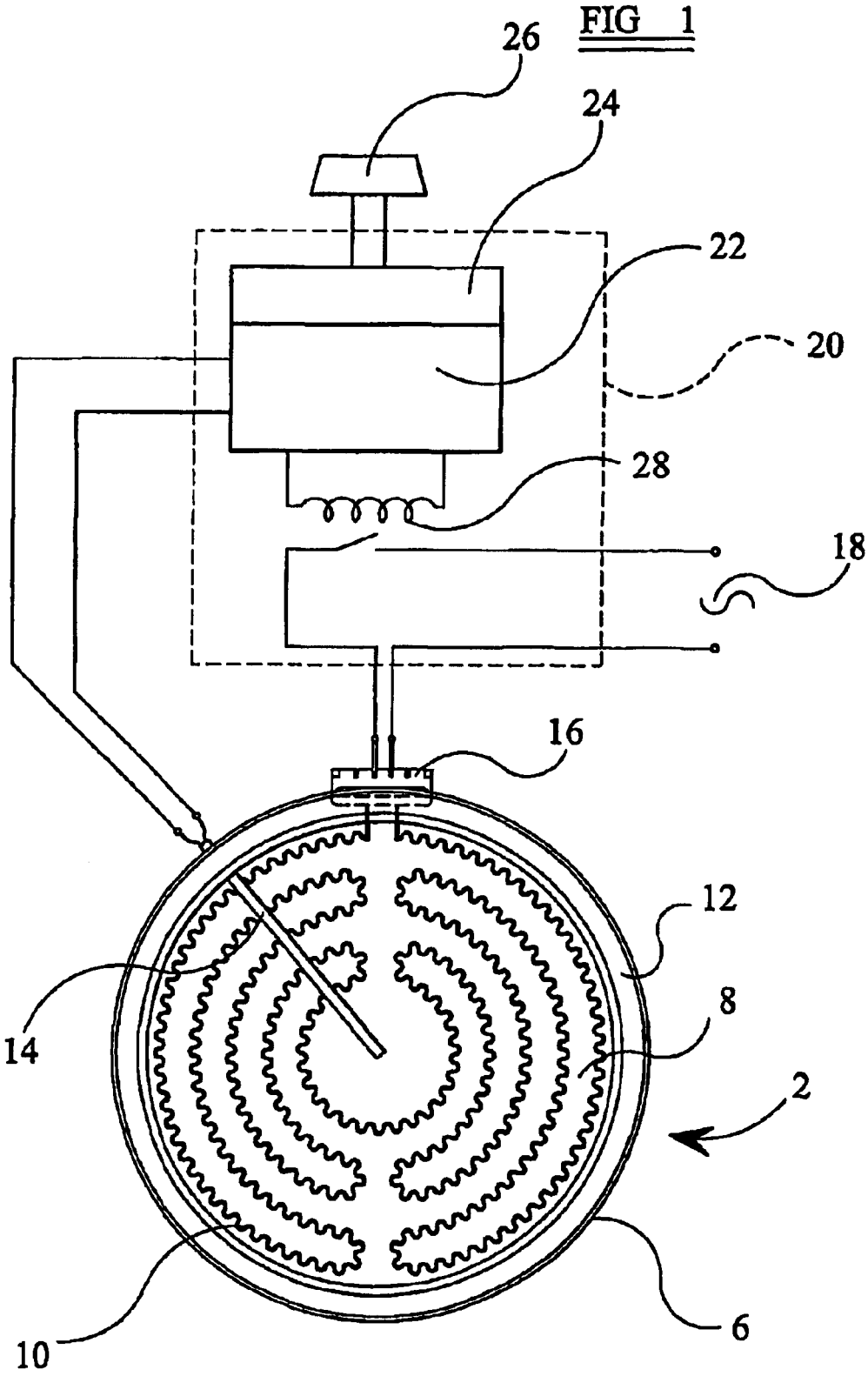
FIG. 1 is a plan view of an electric heater for a cooking appliance connected to a controller, according to the present invention.
Figure 2:
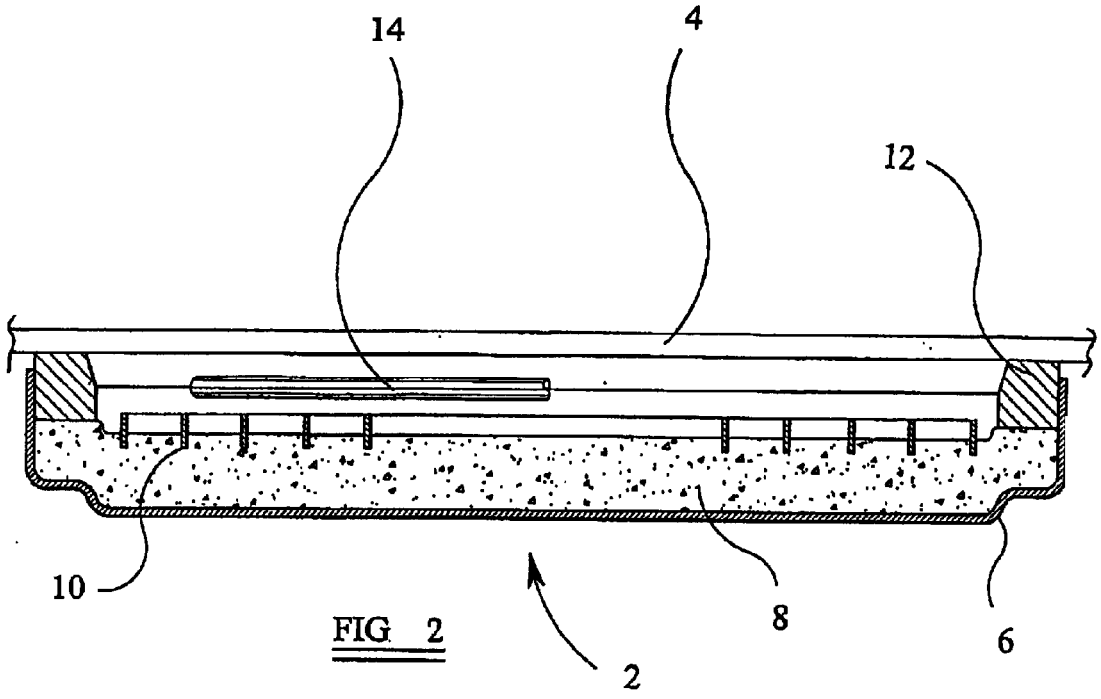
FIG. 2 is a section along line A—A of the heater of FIG. 1 arranged beneath a glass-ceramic cooking surface.

Referring to FIGS. 1 and 2, an electric heater 2 is provided arranged beneath a glass-ceramic surface 4 in a cooking appliance, such as a cooking hob. The heater 2 could instead be provided in an oven of a cooking appliance.

The heater 2 comprises a metal dish 6 having therein a base layer 8 of thermal insulation material, such as compacted microporous thermal insulation material.

A heating element 10 is supported on the base layer 8. As shown, the heating element 10 comprises a corrugated metal ribbon supported edgewise on the base layer 8. However, the heating element 10 could comprise other forms, such as coiled wire or coiled ribbon, or other arrangements of ribbon, or foil, or one or more infra-red lamps. Any of the well-known forms of heating element, or combinations thereof, could be considered, the invention not being restricted to any particular form of heating element.

A peripheral wall 12 of thermal insulation material is provided, having a top surface which contacts the underside of the glass-ceramic cooking surface 4.

A temperature sensor 14 is arranged to extend partially across the heater, between the heating element 10 and the glass-ceramic surface 4. The temperature sensor 14 suitably comprises a tube, such as of metal or ceramic, having therein a device which provides an electrical output as a function of temperature. The device suitably comprises a resistance temperature detector (RTD), such as a platinum resistance temperature detector (PRTD), whose electrical resistance changes as a function of temperature. Alternatively, the device could comprise a thermistor or a thermocouple.

A terminal block 16 is provided at the edge of the heater and by means of which the heating element 10 is arranged to be electrically connected to a power supply 18 for energisation.

Control circuitry 20 is provided for the heater 2. Such control circuitry suitably comprises a microprocessor controller 22. A cyclic energy regulator 24 is also provided, which has a control knob 26 by means of which a plurality of user-selectable power level settings of the heater can be achieved.

Power is supplied to the heater 2 from the power supply 18 by way of a relay 28, or by way of a solid state switch means.

The temperature at or adjacent to the glass-ceramic surface 4 is monitored by the temperature sensor 14 in association with the microprocessor controller 22 to which it is connected.

Figure 3:
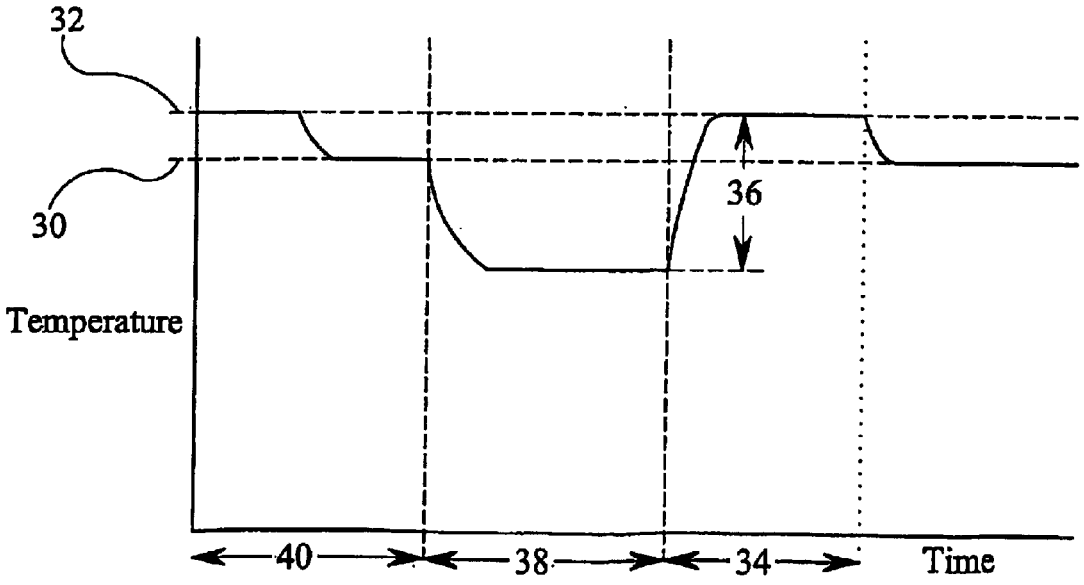
FIG. 3 is a graph illustrating control of temperature of the cooking appliance with time.

Referring now to FIG. 3, the glass-ceramic cooking surface 4 can be operated continuously without damage at a predetermined safe long term maximum operating temperature, denoted by reference numeral 30. However, at the commencement of a cooking cycle, this predetermined safe long term maximum operating temperature may be temporarily exceeded for a short period of time with safety, by initiating a boost condition. This boost condition may, for example, be arranged in order to achieve fastest possible boil time for a food item in a cooking utensil located on the glass-ceramic surface 4. The boost condition results in a boost temperature being attained, as denoted by reference numeral 32, and which is a predetermined safe short term maximum operating temperature for the glass-ceramic surface 4.

The boost condition is initiated by increasing the setting of the energy regulator 24 to a maximum level of setting from a lower level of setting. Such lower level of setting may be in a range from a minimum or 'OFF' setting, in which the heating element 10 is not energised, up to about 70 percent of the maximum setting. The heating element 10 is arranged to be energised at maximum power level in the maximum level of setting.

The duration 34 of each boost condition and the level of temperature boost 36 in each boost condition is required to be accurately controlled. This is effected by monitoring elapsed time 38 since an end of an immediately previous period of operation at the maximum power level in an immediately previous cooking cycle 40 and also by monitoring difference in power levels between the maximum power level and the previous lower power level. The elapsed time 38 represents cooling-off time of the glass-ceramic cooking surface 4 between successive cooking cycles.

In one embodiment of the present invention, a predetermined maximum reference period and a predetermined minimum reference period are provided, to which the monitored elapsed time 38 is referred.

If the monitored elapsed time 38 is greater than the predetermined maximum reference period, the duration 34 of the boost condition is set to a maximum value referred thereto. In a particular example, the predetermined maximum reference period is about 22–30 minutes and the duration 34 of the boost condition is set to a maximum value of about 7–8 minutes.

If the monitored elapsed time 38 is less than the predetermined minimum reference period, the duration 34 of the boost condition is set to a minimum value referred thereto. In a particular example, the predetermined minimum reference period is about 1 minute and the duration 34 of the boost condition is set to a minimum value of about 0 minutes, which means that substantially no boost condition is initiated.

If the monitored elapsed time 38 is between the predetermined maximum reference period and the predetermined minimum reference period, the duration 34 of the boost condition is set to a value in proportion to the elapsed time 38. In a particular example, the duration 34 of the boost condition is set to about one third of the elapsed time 38.

If the difference in power levels between the maximum power level and the previous lower power level is relatively small, a correspondingly relatively small change in the level of temperature boost 36 is effected. This means that a relatively small change in temperature up to the level of the boost temperature 32 is effected. By way of example, if the previous lower power level is about 50 percent of the maximum power level, the change 36 in temperature up to the level of the boost temperature 32 is about 5 degrees Celsius.

If the difference in power levels between the maximum power level and the previous lower power level is relatively large, a correspondingly relatively large change 36 in temperature up to the level of the boost temperature 32 is effected. By way of example, if the previous power level is about 10 percent of the maximum power level, the change 36 in temperature up to the level of the boost temperature 32 is about 20 degrees Celsius.

In a further embodiment of the present invention, the duration 34 of the boost condition is set in proportion to the magnitude of the difference in power levels between the maximum power level and the previous lower power level. In this further embodiment the level of the temperature boost 36 in the boost condition is set in proportion to the monitored elapsed time 38 since the end of the immediately previous period of operation at the maximum power level. Predetermined maximum and minimum reference periods are provided, to which the monitored elapsed time 38 is referred.

If the monitored elapsed time 38 is greater than the predetermined maximum reference period, the level 36 of the temperature boost is set to a maximum referred thereto. For example, for elapsed times greater than a predetermined maximum reference period of about 30 minutes, the maximum temperature boost may be about 30 degrees.

If the monitored elapsed time 38 is less than the predetermined minimum reference period, the level 36 of the temperature boost is set to a minimum referred thereto. For example, for elapsed times less than a predetermined minimum reference period of about 1 minute, the minimum temperature boost may be about 0 degrees.

If the monitored elapsed time 38 is between the predetermined maximum reference period and the predetermined minimum reference period, the level 36 of the temperature boost is set to a value in proportion to the elapsed time 38. For example, for the predetermined maximum and minimum reference periods given above, for an elapsed time of about 10 minutes the temperature boost may be about 10 degrees.

What is claimed is:

1. A method of controlling an electric cooking appliance whereby at commencement of a recurrent cooking cycle a boost condition is selected such that an operating temperature of the appliance is boosted above a predetermined safe long term maximum operating temperature (30) to a boost temperature (32) which is a predetermined safe short term maximum operating temperature, the appliance including energy regulating means (24) for controlling power level of one or more electric heating means (2) in the appliance, and temperature sensing means (14) for monitoring the operating temperature of the appliance, the method comprising the steps of: initiating the boost condition by increasing the power level of the one or more electric heating means (2) to a maximum power level from a previous lower power level; monitoring elapsed time (38) since an end of an immediately previous period at the maximum power level and during which cooling of the appliance occurs; monitoring difference in power levels between the maximum power level and the previous lower power level; and setting duration (34) of the boost condition according to one of the elapsed time (38) and the difference in power levels and correspondingly setting a level (36) of temperature boost in the boost condition according to one of the difference in power levels and the elapsed time, respectively.

2. A method according to claim 1, wherein the boost condition is initiated by increasing a setting of the energy regulating means (24) to a maximum setting from a lower level setting.

3. A method according to claim 2, wherein the lower level setting is in a range from a minimum setting, in which the one or more electric beating means (2) is or are not energised, up to about 70 percent of the maximum setting, the one or more electric heating means being energised at the maximum power level in the maximum setting.

4. A method according to claim 1, wherein a predetermined maximum reference period and a predetermined minimum reference period are provided, to which the monitored elapsed time (38) is referred.

5. A method according to claim 4, wherein the monitored elapsed time (38) is greater than the predetermined maximum reference period and the duration (34) of the boost condition is set to a maximum value referred thereto.

6. A method according to claim 5, wherein the predetermined maximum reference period is about 22–30 minutes and the set maximum value of the duration (34) of the boost condition is about 7–8 minutes.

7. A method according to claim 4, wherein the monitored elapsed time (38) is less than the predetermined minimum reference period and the duration (34) of the boost condition is set to a minimum value referred thereto.

8. A method according to claim 1, wherein the predetermined minimum reference period is about 1 minute and the set minimum value of the duration (34) of the boost condition is about 0 minutes.

9. A method according to claim 4, wherein the monitored elapsed time (38) is between the predetermined maximum reference period and the predetermined minimum reference period and the duration (34) of the boost condition is set to a value in proportion to the elapsed time.

10. A method according to claim 9, wherein the duration (34) of the boost condition is set to a value of about one third of the elapsed time (38).

11. A method according to claim 1, wherein the difference in power levels between the maximum power level and the previous lower power level is relatively small and a correspondingly relatively small change in temperature up to the level of the boost temperature (32) is effected.

12. A method according to claim 11, wherein the previous lower power level is about 50 percent of the maximum power level and the change in temperature up to the level of the boost temperature (32) is about 5 degrees Celsius.

13. A method according to claim 11, wherein the difference in power levels between the maximum power level and the previous lower power level is relatively large and a correspondingly relatively large change in temperature up to the level of the boost temperature (32) is effected.

14. A method according to claim 13, wherein the previous lower power level is about 10 percent of the maximum power level and the change in temperature up to the level of the boost temperature (32) is about 20 degrees Celsius.

15. A method according to claim 1, wherein the duration (34) of the boost condition is set in proportion to the magnitude of the difference in power levels between the maximum power level and the previous lower power level.

16. A method according to claim 15, wherein the level (36) of the temperature boost in the boost condition is set in proportion to the monitored elapsed time (38).

17. A method according to claim 16, wherein predetermined maximum and minimum reference periods are provided, to which the monitored elapsed time (38) is referred.

18. A method according to claim 17, wherein the monitored elapsed time (38) is greater than the predetermined maximum reference period and the level (36) of the temperature boost is set to a maximum referred thereto.

19. A method according to claim 17, wherein the monitored elapsed time (38) is less than the predetermined minimum reference period and the level (36) of the temperature boost is set to a minimum referred thereto.

20. A method according to claim 17, wherein the monitored elapsed time (38) is between the predetermined maximum reference period and the predetermined minimum reference period and the level (36) of the temperature boost is set to a value in proportion to the elapsed time.

21. A method according to claim 1, wherein the temperature sensing means (14) comprises an electrical resistance temperature detector.

22. A method according to claim 21, wherein the electrical resistance temperature detector (14) comprises a platinum resistance sensing element.

23. A method according to claim 1, wherein the electric cooking appliance comprises an electric oven and/or an electric hob.

24. Apparatus for controlling an electric cooking appliance whereby at commencement of a recurrent cooking cycle a boost condition is selectable such that an operating temperature of the appliance is able to be boosted above a predetermined safe long term maximum operating temperature (30) to a boost temperature (32) which is a predetermined safe short term maximum operating temperature, the apparatus including energy regulating means (24) for controlling power level of one or more electric heating means (2) in the appliance and temperature sensing means (14) for monitoring the operating temperature of the appliance, wherein means is provided to initiate the boost condition whereby the power level of the one or more electric heating means (2) is increased to a maximum power level from a previous lower power level; means is provided to monitor elapsed time (38) since an end of an immediately previous period at the maximum power level and during which cooling of the appliance occurs; means is provided to monitor difference in power levels between the maximum power level and the previous lower power level; and means is provided to set duration (34) of the boost condition according to one of the elapsed time (38) and the difference in power levels and to correspondingly set a level (36) of temperature boost in the boost condition to one of the difference in power levels and the elapsed time (38), respectively.

25. Apparatus as claimed in claim 24, wherein the boost condition is initiated by increasing a setting of the energy regulating means (24) to a maximum setting from a lower level setting.

26. Apparatus as claimed in claim 25, wherein the lower level setting is in a range from a minimum setting, in which the one or more electric heating means (2) is or are not energised, up to about 70 percent of the maximum setting, the one or more electric heating means being energised at the maximum power level in the maximum setting.

27. Apparatus as claimed in claim 24, wherein a predetermined maximum reference period and a predetermined minimum reference period are provided, to which the monitored elapsed time (38) is referred.

28. Apparatus as claimed in claim 26, wherein the monitored elapsed time (38) is greater than the predetermined maximum reference period and the duration (34) of the boost condition is set to a maximum value referred thereto.

29. Apparatus as claimed in claim 28, wherein the predetermined maximum reference period is about 22–30 minutes and the set maximum value of the duration of the boost condition is about 7–8 minutes.

30. Apparatus as claimed in claim 21, wherein the monitored elapsed time (38) is less than the predetermined minimum reference period and the duration (34) of the boost condition is set to a minimum value referred thereto.

31. Apparatus as claimed in claim 30, wherein the predetermined minimum reference period is about 1 minute and the set minimum value of the duration of the boost condition is about 0 minutes.

32. Apparatus as claimed in claim 27, wherein the monitored elapsed time (38) is between the predetermined maximum reference period and the predetermined minimum reference period and the duration (34) of the boost condition is set to a value in proportion to the elapsed time.

33. Apparatus as claimed in claim 32, wherein the duration (34) of the boost condition is set to a value of about one third of the elapsed time (38).

34. Apparatus as claimed in claim 24, wherein the difference in power levels between the maximum power level and the previous lower power level is relatively small and a correspondingly relatively small change in temperature up to the level of the boost temperature (32) is effected.

35. Apparatus as claimed in claim 34, wherein the previous lower power level is about 50 percent of the maximum power level and the change in temperature up to the level of the boost temperature (32) is about 5 degrees Celsius.

36. Apparatus as claimed in claim 34, wherein the difference in power levels between the maximum power level and the previous lower power level is relatively large and a correspondingly relatively large change in temperature up to the level of the boost temperature (32) is effected.

37. Apparatus as claimed in claim 36, wherein the previous lower power level is about 10 percent of the maximum power level and the change in temperature up to the level of the boost temperature (32) is about 20 degrees Celsius.

38. Apparatus as claimed in claim 24, wherein the duration (34) of the boost condition is set in proportion to the magnitude of the difference in power levels between the maximum power level and the previous lower power level.

39. Apparatus as claimed in claim 38, wherein the level (36) of the temperature boost in the boost condition is set in proportion to the monitored elapsed time (38).

40. Apparatus as claimed in claim 39, wherein predetermined maximum and minimum reference periods are provided, to which the monitored elapsed time (38) is referred.

41. Apparatus as claimed in claim 40, wherein the monitored elapsed time (38) is greater than the predetermined maximum reference period and the level (36) of the temperature boost is set to a maximum referred thereto.

42. Apparatus as claimed in claim 40, wherein the monitored elapsed time (38) is less than the predetermined minimum reference period and the level (36) of the temperature boost is set to a minimum referred thereto.

43. Apparatus as claimed in claim 40, wherein the monitored elapsed time (38) is between the predetermined maximum reference period and the predetermined minimum reference period and the level (36) of the temperature boost is set to a value in proportion to the elapsed time.

44. Apparatus as claimed in claim 24, wherein the temperature sensing means (14) comprises an electrical resistance temperature detector.

45. Apparatus as claimed in claim 44, wherein the electrical resistance temperature detector (14) comprises a platinum resistance-sensing element.

46. Apparatus as claimed in claim 24, wherein the electric cooking appliance comprises an electric oven and/or an electric hob.

* * * * *